US005428263A

United States Patent [19]

Nagano

[11] Patent Number: 5,428,263

[45] Date of Patent: Jun. 27, 1995

[54] DISCHARGE CATHODE DEVICE WITH STRESS RELIEVING LAYER AND METHOD FOR MANUFACTURING THE SAME

[75] Inventor: Shinichirou Nagano, Hyogo, Japan

[73] Assignee: Mitsubishi Denki Kabushiki Kaisha, Tokyo, Japan

[21] Appl. No.: 998,919

[22] Filed: Dec. 30, 1992

[30] Foreign Application Priority Data

| | | | |
|---|---|---|---|
| Jan. 7, 1992 | [JP] | Japan | 4-000785 |
| Jan. 7, 1992 | [JP] | Japan | 4-000905 |
| May 22, 1992 | [JP] | Japan | 4-130584 |
| Jul. 31, 1992 | [JP] | Japan | 4-224659 |

[51] Int. Cl.[6] ..... H01J 17/49

[52] U.S. Cl. ..... 313/585; 313/484; 313/494; 313/518; 313/587; 313/602; 313/603; 315/169.3; 315/169.4; 345/67

[58] Field of Search ..... 313/484, 494, 518, 582, 313/584, 585, 587, 602, 603, 633; 315/169.3, 169.4; 345/67

[56] References Cited

U.S. PATENT DOCUMENTS

| | | | |
|---|---|---|---|
| 3,858,284 | 1/1975 | Costa et al. | 313/584 |
| 3,976,907 | 8/1976 | Yanagisawa et al. | 313/582 |
| 4,393,326 | 7/1983 | Kamegaya et al. | 313/582 |
| 4,562,434 | 12/1985 | Amano | 315/169.4 |
| 4,599,076 | 7/1986 | Yokono et al. . | |
| 4,780,644 | 10/1988 | Sakai et al. | 313/582 |
| 4,926,095 | 5/1990 | Shinoda et al. | 313/484 |
| 4,996,460 | 2/1991 | Kim et al. | 313/587 |
| 5,107,176 | 4/1992 | Endo et al. | 313/582 |
| 5,207,607 | 5/1993 | Nagano et al. | 313/582 |

FOREIGN PATENT DOCUMENTS

| | | |
|---|---|---|
| 0451362 | 10/1991 | European Pat. Off. . |
| 55-62647 | 5/1980 | Japan . |
| 58-030038 | 2/1983 | Japan . |
| 61-253736 | 11/1986 | Japan . |
| 3-101033 | 4/1991 | Japan . |
| 3-269934 | 12/1991 | Japan . |
| 4-048534 | 2/1992 | Japan . |

*Primary Examiner*—Sandra L. O'Shea
*Assistant Examiner*—Matthew J. Esserman
*Attorney, Agent, or Firm*—Rothwell, Figg, Ernst & Kurz

[57] ABSTRACT

According to the present invention there is provided a discharge cathode device comprising: a substrate, an Al layer formed on the substrate, and a layer of hexabonide of either lanthanum, a lanthanide or yttnium formed on the Al layer. There is also provided a method for manufacturing the same and a gas discharge display device having the same. This cathode device including a multilayer structure exhibits excellent conductivity, flexibility, and thermal oxidation resistance and also can be produced at low cost. The gas discharge display device achieves superior insulation and can be produced with a small number of steps.

2 Claims, 10 Drawing Sheets

DISCHARGE CATHODE DEVICE WITH STRESS RELIEVING LAYER AND METHOD FOR MANUFACTURING THE SAME

BACKGROUND OF THE INVENTION

1. Field of the Invention

The present invention relates to a discharge cathode device and a method for manufacturing the same for use with a plasma display panel or the like.

2. Description of Prior Art

A hexaboride such as a lanthanum hexaboride ($LAB_6$) superior in electron radiation characteristic and ion impact resistance is known as a discharge cathode material for the discharge cathode device.

In Japanese Patent Laid-open Publication No. 55-62647, for example, there is described that a hexaboride (e.g., $LAB_6$) is used as a cathode of a gas discharge display panel such as a plasma display panel, and an $LaB_6$ film is formed on a base electrode such as nickel (Ni), wherein an operating voltage can be greatly reduced.

Among methods for forming the $LaB_6$ film are a thick film printing method and a thin film method, etc. as described in the above Japanese Patent Laid-open Publication No. 55-62647. Also disclosed are an electron beam impact vapor deposition method and a sputtering method in Japanese Patent Laid-open Publication No. 61-253736 or Japanese Patent Laid-open Publication No. 3-101033.

In general, a sheet resistance in a cathode of a plasma display panel must be set to 0.1 Ω or less. Therefore, in the case where the cathode on a substrate solely comprises the $LaB_6$ thin film, the thickness of the $LaB_6$ thin film must be set to as great as tens of μ m, and the film tends to peel off the substrate, thus lacking practical applicability. To cope with this problem, as described in Japanese Patent Laid-open Publication No. 55-62647, a Ni plate as a base electrode for the $LaB_6$ film is formed on the substrate to thereby reduce the thickness of the $LaB_6$ film.

In the discharge cathode device for a plasma display panel or the like, the material of the base electrode for the $LaB_6$ film must have the following properties.

(1) Good conductivity (2) Superior adhesion to the $LaB_6$ film (3) Good flexibility, i.e., low rigidity (Since the $LaB_6$ film receives great stress, it will break if it is not flexible.)

(4) Resistance against oxidation in heat treatment (at 560°–580° C.) in the air to be performed later.

It is known that the base electrode of Ni can be formed by a thick film method or a thin film method. The Ni thin film is poor in flexibility and conductivity and not satisfactory in thermal oxidation resistance. Accordingly, if one wants the Ni film to be thickened so as to ensure a good conductivity, then the Ni film becomes more rigid and there arises a problem that the substrate will be broken in the heat treatment to be performed later.

Further, according to Japanese Patent Laid-open Publication No. 55-62647, a Ni thin film pattern and an $LaB_6$ film pattern must be individually formed (i.e. collective patterning by means of etching is impossible), and it is difficult to accurately align the Ni thin film pattern with the $LaB_6$ film one.

On the other hand, when a Ni thick film is used for the base electrode, it shows a good adhesion to the $LaB_6$ film. However, since the surface of the Ni thick film is rough, the surface of the $LaB_6$ film to be formed on the rough surface of the Ni thick film becomes also rough enough to cause poor adhesion therebetween. Consequently, that happens to cause the problem that the discharge initiating voltage is different from each other in each cell arranged in matrix array with both patterns of anodes and cathodes.

SUMMARY OF THE INVENTION

It is accordingly an object of the present invention to provide a discharge cathode device having a discharge cathode to be obtained from an electrode material superior in flexibility, conductivity and thermal oxidation resistance.

It is another object of the present invention to provide a manufacturing method for the above discharge cathode device.

It is a further object of the present invention to provide a plasma display panel having such a structure as to eliminate the problem in withstand voltage and to enhance the trigger effect, with making the patterning process for a plurality of thin films easy with less steps.

According to a first aspect of the present invention there is provided a discharge cathode device comprising: a substrate, an Al layer formed on the substrate, and a layer of hexabonide of either lanthanum, a lanthanide or yttrium formed on the Al layer.

According to a second aspect of the present invention there is provided a method for manufacturing a discharge cathode device comprising the steps of: preparing a substrate; forming an Al layer on the substrate; forming a layer of hexaboride of either lanthenum, a lanthanide or or yeltrium on the Al layer; and etching the Al layer together with the layer of hexaboride so as to pattern the discharge cathode device.

According to a third aspect of the present invention there is provided a method for manufacturing a discharge cathode device comprising the steps of: forming a multilayer cathode pattern including an Al layer and a layer of hexabonide of either lanthanum, lanthanide or yttrium on a dielectric glass plate; forming a connecting electrode connected to the multilayer cathode pattern on the dielectric glass plate; and sintering the connecting electrode under temperature lower than a softening point of the dielectric glass plate.

According to a fourth aspect of the present invention there is provided a discharge cathode device comprising: a substrate; a Cr layer formed on the substrate; an Al layer formed on the Cr layer; and a layer of hexaboride of either lanthanum, a lanthanide or yttrium formed on the Al layer.

According to a fifth aspect of the present invention there is provided a method for manufacturing a discharge cathode device comprising the steps of: preparing a substrate; forming a Cr layer on the substrate; forming an Al layer on the Cr layer; forming a layer of hexaboride of either lanthanum, a lanthanide or yttrium on the Al layer; and etching the Al layer together with the layer of hexaboride so as to pattern the discharge cathode device.

According to a sixth aspect of the present invention there is provided a method for manufacturing a discharge cathode device comprising the steps of: preparing a substrate; forming a thin dielectric film on the substrate; forming a Cr layer on the thin dielectric film; forming an Al layer on the Cr layer; forming a layer of hexaboride or either lanthanum, lanthanide or yttrium on the Al layer; and etching the Al layer together with the layer of hexaboride so as to pattern the discharge cathode device.

According to a seventh aspect of the present invention there is provided a method for manufacturing a discharge cathode device comprising the steps of: forming a multilayer cathode pattern including a Cr layer, an Al layer and a layer of hexaboride of either landlanum, a lanthanoid or yttrium on a dielectric glass plate; forming a connecting electrode connected to the multilayer cathode pattern on the dielectric glass plate; and sintering the connecting electrode under temperature lower than a softening point of the dielectric glass plate.

According to an eighth aspect of the present invention there is provided a method for manufacturing a discharge cathode device comprising the steps of: forming a multilayer cathode pattern including at least an Al layer and a layer of hexaboride or either lanthanum, lanthanide or yttrium on a substrate; and arranging an insulator between adjacent cathodes of the cathode pattern.

According to a ninth aspect of the present invention there is provided a discharge cathode device comprising: a cathode-side panel; a multilayer cathode pattern including an Al layer and a layer of hexaboride of either lanthanum, a lanthanide or yttrium formed on the cathode-side panel; a connecting electrode formed on the cathode-side panel and connected to the multilayer cathode pattern; a cathode terminal electrode formed on the cathode-side panel and connected to the connecting electrode; an anode-side panel opposing to the cathode-side panel; an anode pattern formed on the anode-side panel; and a sealing member adhering to all periphery of the cathode-side panel and anode-side panel with touching the connecting electrode or cathode terminal electrode so as to confine the multilayer cathode pattern and the anode pattern.

According to a tenth aspect of the present invention there is provided a gas discharge display device comprising: a cathode-side panel including a cathode pattern having a plurality of cathode lines formed thereon extending to one side of the cathode-side panel and a trigger electrode pattern having a plurality of insulator-covered trigger electrode lines formed thereon arranged between the adjacent cathode lines and extending to another side of the cathode-side panel; an anode-side panel having an anode pattern formed thereon; and a sealing means for sealing the cathode-side panel and the anode-side panel.

According to an eleventh aspect of the present invention there is provided a gas discharge display device comprising: a cathode-side panel including a cathode pattern having a plurality of cathode lines formed thereon; a trigger electrode pattern having a plurality of insulator-covered trigger electrode lines formed thereon arranged between the adjacent cathode lines, both of the cathode pattern and the trigger electrode pattern formed in entity and comprising the same material with each other; an anode-side panel having an anode pattern formed thereon; and a sealing means for sealing the cathode-side panel and the anode-side panel.

According to a twelfth aspect of the present invention there is provided a cathode-side panel including a cathode pattern having a plurality of cathode lines formed thereon and covered with an insulator at the pattern edge a trigger electrode pattern having a plurality of trigger electrode lines formed thereon arranged between the adjacent cathode lines, both of the cathode pattern and the trigger electrode pattern formed in entity and comprising the same material with each other; an anode-side panel having an anode pattern formed thereon; and a sealing means for sealing the cathode-side panel and the anode-side panel.

DETAILED DESCRIPTION OF THE PREFERRED EMBODIMENTS

Example 1

Figure 1A:
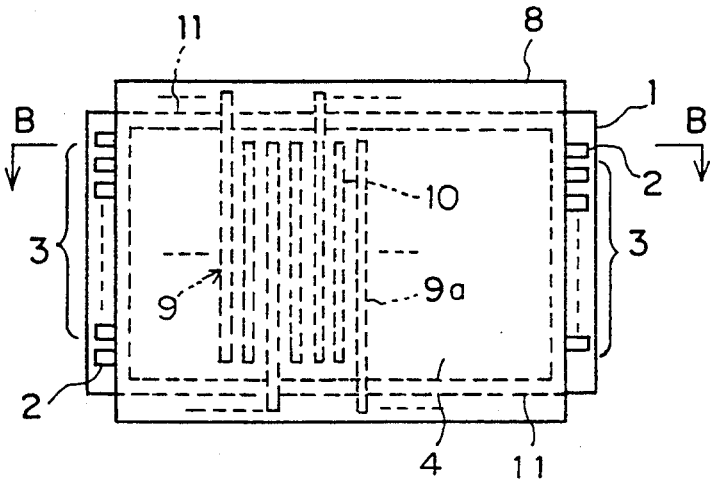
FIG. 1A is a plan view of a plasma display panel including a discharge cathode device according to one embodiment of the present invention.
Figure 1B:
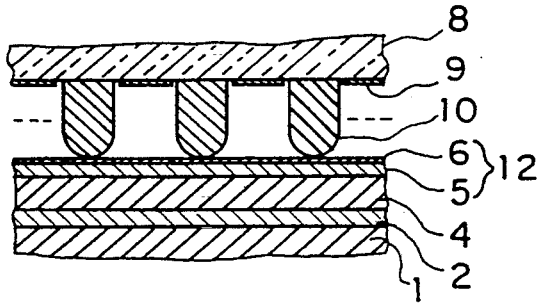
FIG. 1B is a partial cross sectional view taken along the line B—B in FIG. 1A.

Referring to FIGS. 1A and 1B, there is shown a plasma display panel employing a discharge cathode device according to the present example.

The plasma display panel includes a cathode-side panel substrate 1 made of soda glass as a base material, a trigger electrode 2 formed on the substrate 1 by a thick film method (screen printing in this example; the same hereinafter) using conductive paste containing Ag as a principal material, a plurality of terminal electrodes 3 formed on the substrate 1 by a thick film method using conductive paste containing Ag, and a dielectric glass substrate 4 formed on the trigger electrode 2 by a thick film method using dielectric glass paste as a base material. The dielectric glass substrate 4 has a film thickness of 40 μm.

As will be hereinafter described in detail, discharge variations in each luminous cell (e.g. discharge luminous shape, discharge starting voltage, etc. of luminous cells) can be reduced by suppressing an average surface roughness of the dielectric glass substrate 4 to 1–2 μm or less.

An Al layer 5 as a thin film having a thickness of 2 μm is formed on the substrate 4 under a substrate temperature of 200° C. by sputtering (vapor deposition or ion plating is also possible). The thickness of the Al layer 5 is preferably 0.5 μm or more from the viewpoint of conductivity. An $LaB_6$ layer 6 as a thin film having a thickness of 0.2 μm is formed on the Al layer 5 by sputtering. The thickness of the $LaB_6$ layer 6 is preferably 0.1 μm or more so as to cover the Al layer 5 as an underlying layer. The Al layer 5 and the $LaB_6$ layer 6 jointly form a cathode pattern 12 made up of a plurality of cathode lines. The cathode pattern 12 constitutes a discharge cathode.

The thin film of the $LaB_6$ layer 6 formed by sputtering has a large internal stress. Thus, its form of thin film is hard to maintain and the thin film is liable to scatter powder.

However, in this example, since the Al layer 5 is formed as an underlying layer for the $LaB_6$ layer 6, the internal stress of the $LaB_6$ layer 6 is considerably absorbed by the Al layer 5 owing to flexibility of Al. Therefore, the thickness of the $LaB_6$ layer 6 can be reduced down to a submicron level where no peeling off is likely to occur.

The plasma display panel further includes an anode-side panel substrate 8 made of soda glass as a base material, an anode pattern 9 made up of a plurality of anode lines 9a formed on the substrate 8, a plurality of barrier ribs 10 each arranged between the adjacent anode lines 9a and formed by a thick film method, and a sealing member 11 made of low-melting point glass for adhering to the cathode-side panel substrate 1 and the anode-side panel substrate 8 at their outer peripheral portions with sealing discharge gas therebetween. The discharge gas such as Ne-Ar is airtightly confined inside the space surrounded by the sealing member 11. The plasma display panel is built in this manner.

While the Al layer 5 is used as an underlying layer for the $LaB_6$ layer 6 in this example, presented in Table 1 is the comparison with an Ni layer (thick film and thin film as aforementioned), an Ag layer (thin film) and an Au layer (thin film).

TABLE 1

| | | Properties of Discharge Electrode Materials | | | |
|---|---|---|---|---|---|
| | Underlying Layer for $LaB_6$ | Flexibility (Rigidity; dyn/cm$^2$) | Conductivity (Specific Resistance; Ω · cm) | Adhesion of $LaB_6$ to the Underlying Layer | Thermal Oxidation Resistance |
| Example 1 | Al | ○ ($2.67 \times 10^{11}$) | ○ ($2.66 \times 10^{-6}$) | ○ | ○ |
| Control 1 | Ni (Thick film) | ○ (−) | Δ (about $200 \times 10^{-6}$) | ○ | ○ |
| Control 2 | Ni (Thin film) | x ($7.7 \times 10^{11}$) | x ($6.9 \times 10^{-6}$) | ○ | x |
| Control 3 | Ag | ○ ($2.87 \times 10^{11}$) | ○ ($1.62 \times 10^{-6}$) | x | ○ |
| Control 4 | Au | ○ ($2.77 \times 10^{11}$) | ○ ($2.2 \times 10^{-6}$) | ○ | ○ |

○: Excellent
Δ: Medium
x: Poor

As apparent from Table 1, the Al layer of this example is good in all of the flexibility, the conductivity, the adhesion to the $LaB_6$ layer, and the thermal oxidation resistance. In particular, it is excellent in the adhesion to the $LaB_6$ layer. Even when formed by a thin film method like sputtering and so forth, the Al layer 5 in this example is superior in the adhesion to the $LaB_6$ layer 6. All the thin films of the Al layer of Example 1, the Ag layer of Control 3, and the Au layer of Control 4 as well as the Ni layer of Control 2 have thickness of 2 μm.

The Ni layer (thin film) of Control 2 is good in the adhesion to the $LaB_6$ layer as alike to the Al layer, but it is not so good in the flexibility and the conductivity. The Ni layer (thick film; 30 μm thick) of Control 1 is good in the conductivity, but the discharge characteristics of the $LaB_6$ layer cannot be effected. That is, the surface of the $LaB_6$ layer becomes uneven, because of the uneven surface of the Ni layer (thick film), enough to deteriorate the discharge characteristics such as the luminous shape of cells and the discharge starting voltage.

The Ag layer of Control 3 is the most excellent in the conductivity, but it is not so good in the adhesion to the $LaB_6$ layer. Furthermore, the form of the thin film cannot be maintained, scattering powder.

The Au layer of Control 4 is good in the flexibility and the conductivity. It is also good in the adhesion to the $LaB_6$ layer (however, poorer than the Al layer) and the thermal oxidation resistance. Accordingly, the Au layer is employable as the underlying layer electrode for the $LaB_6$ layer, but it is not practically applicable because of its high cost.

After all, it is considered that Al is an optimum material for the underlying electrode layer for the $LaB_6$ layer 6 from the viewpoints of cost and batch patterning with the $LaB_6$ layer 6.

While the $LaB_6$ layer 6 is formed on the Al layer 5 in this example, hexaboride or either lanthanum, lanthanides, such as $CeB_6$, $PrB_6$, $NdB_6$, $SmB_6$, $EuB_6$, etc. may be used instead of $LaB_6$. Further, $YB_6$ may also be used.

A manufacturing process for the plasma display panel shown in FIG. 1A will now be explained with reference to FIGS. 2A to 2D.

Figure 2A:
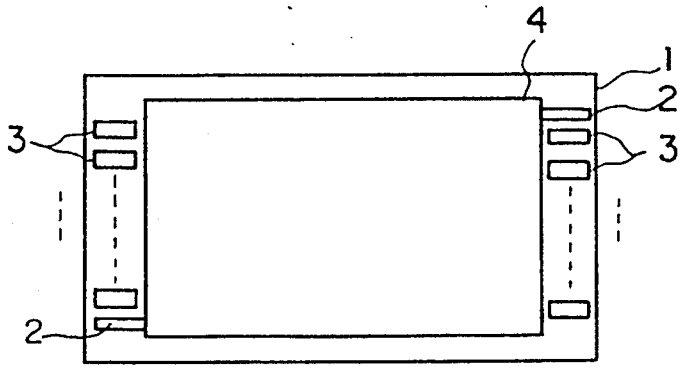
FIGS. 2A to 2D are plan views illustrating each step of a method for manufacturing the discharge cathode device shown in FIG. 1A.

In the first step shown in FIG. 2A, the trigger electrode 2 and the terminal electrode 3 both made of conductive paste containing Ag as a base material are formed on the cathode-side panel substrate 1 by a thick film method. Then, the dielectric glass substrate 4 having a film thickness of 40 μm is formed on the trigger electrode 2 by a thick film method.

Figure 2B:
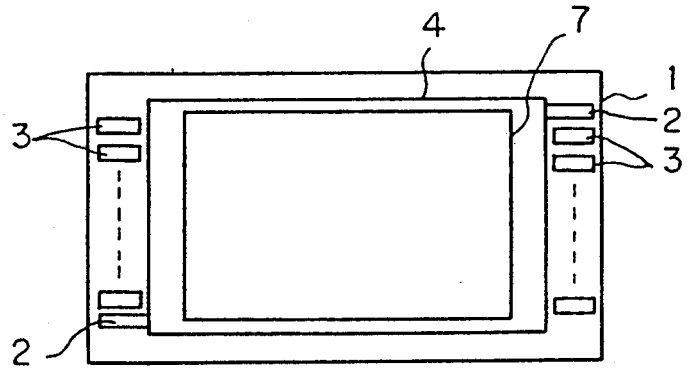

In the second step shown in FIG. 2B, the Al layer 5 and the $LaB_6$ layer 6 are formed in order on the dielectric glass substrate 4 by sputtering to form a multilayer thin film 7. In forming the multilayer thin film 7, a mask is provided to cover an exposed portion of the trigger electrode 2 and an area of the terminal electrodes 3 so as not to be covered with the Al layer 5 or the $LaB_6$ layer 6, whereby, in a patterning step to be performed later, the trigger electrode 2 and the terminal electrodes 3 can be protected from an etching liquid for the Al layer 5 and $LaB_6$ layer 6.

Figure 2C:
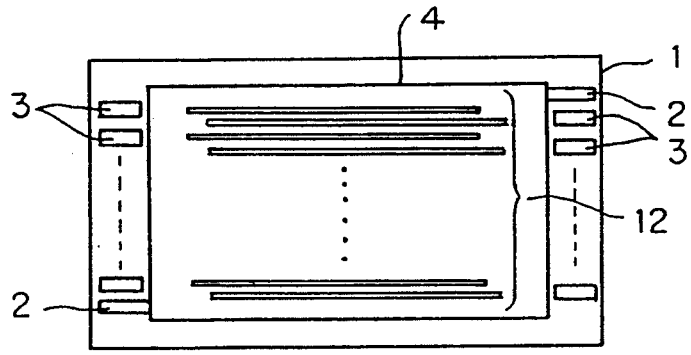

In the third step shown in FIG. 2C, a photoresist film is applied to a whole surface of the multilayer thin film 7. Then, the photoresist film is exposed to light through a predetermined mask pattern, and development is then performed to form a predetermined photoresist pattern. Then, the $LaB_6$ layer 6 and the Al layer 5 are etched together in order by an etching liquid like a mixed liquid of phosphoric acid, acetic acid and nitric acid. That is, the $LaB_6$ layer 6 is first etched to expose the surface of the Al layer 5 and is followed by the etching of the Al layer 5. Finally, the multilayer thin film 7 having a pattern coincident with the photoresist pattern is obtained to form the cathode pattern 12. Thereafter, the photoresist pattern is removed to obtain the condition shown in FIG. 2C.

Figure 2D:
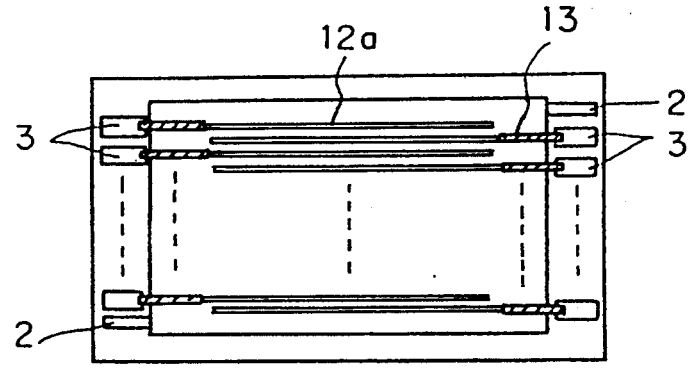

In the fourth step shown in FIG. 2D, a plurality of connecting electrodes 13 are formed by a thick film method using conductive paste containing Ag as a base material, so as to respectively connect the cathode lines 12*a* of the cathode pattern 12 to the terminal electrodes 3.

In this way, the cathode-side panel is obtained.

If the connecting electrodes 13 are burned at a temperature near a softening point of the dielectric glass substrate 4, there is a possibility that surface unevenness of about 20 μm is generated on the surfaces of the cathode pattern 12 and the connecting electrodes 13 after burned, causing remarkable discharge variations amongst the luminous cells.

Figure 3A:
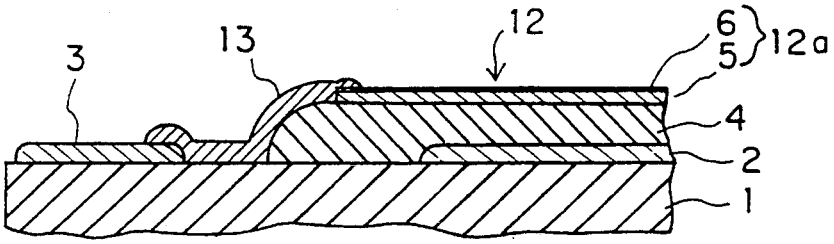
FIG. 3A is a sectional view of an essential part of the discharge cathode device before the burning of connection electrodes shown in FIG. 2D.
Figure 3B:
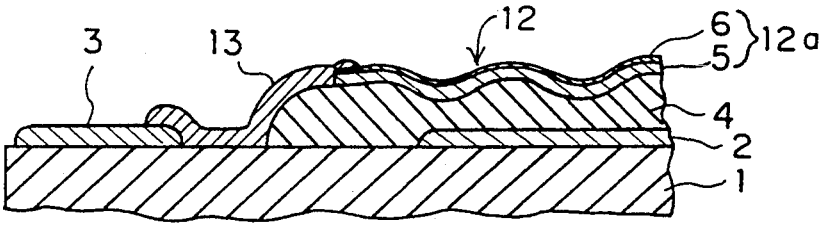
FIG. 3B is a sectional view of the same portion shown in FIG. 3A after the burning of the connection electrodes.

FIG. 3A shows surface condition of the cathode pattern 12 and the connecting electrodes 13 before burned, and FIG. 3B shows surface condition thereof after burned.

A mechanism of generation of such unevenness on the surfaces of the cathode pattern 12 and the connecting electrodes 13 will now be described.

In a temperature rising stage by burning the connecting electrodes 13, the surface condition shown in FIG. 3A is maintained under temperature lower by 50° C. or more than the softening point (e.g. 585° C.) of the dielectric glass substrate 4.

This is due to the following fact. A coefficient of thermal expansion of the Al layer 5 is larger than that of the dielectric glass substrate 4. Thus, while strain is generated on the surface of the substrate 4 during the course of temperature rising, the glass substrate 4 stays flat, since it has rigidity at least larger than that of the Al layer 5. The Al layer 5 having flexibility more than the glass substrate 4 continues to adhere to the glass substrate 4 and stores a compression stress.

However, when the temperature reaches the softening point of the glass substrate 4, the rigidity of the glass substrate 4 disappears, and accordingly the Al layer 5 releases the compression stress stored so far to expand its surface area. As a result, the glass substrate 4 having already no rigidity is pulled by the Al layer 5 to generate the unevenness as shown in FIG. 3B. In this condition, the strain of the surface of the substrate 4 is greatly relaxed.

Finally, in a temperature lowering stage until the temperature decreases down to the softening point of the glass substrate 4, the strain relaxed condition of the glass substrate 4 is maintained.

However, even when the temperature further decreases largely below the softening point, the surface unevenness of the glass substrate 4 is maintained during setting.

Also in the subsequent temperature lowering stage, since the contraction forces of the Al layer 5 is weaker than the rigidity of the glass substrate 4 now set with the uneven surface, tensile stress is stored in the corrugated Al layer 5, and the surface unevenness of the substrate 4 remains. This leads to the corresponding surface roughness of the $LaB_6$ layer 6 formed on the corrugated Al layer 5, causing to deteriorate the discharge characteristics, that is, disorder the luminous shape of the cells and increase the discharge starting voltage.

By the way, a burning temperature of various thick film patterns of the plasma display panel is set in a range of 560°–600° C. This temperature range is determined in view of a mechanical strength of the thick film patterns to be required after burning. For this reason, the burning of the thick film patterns is hitherto performed in the temperature range of 560–600° C. in the step of FIG. 2C.

However, if the connecting electrodes 13 are burned within this temperature range in the step of FIG. 2D, the surface unevenness of the substrate 4 will be generated as described above because this temperature range is in the vicinity of or higher than the softening point of the glass substrate 4.

For instance, when having used the glass substrate 4 having a softening point of 585° C., the surface unevenness of the substrate 4 started to remarkably appear at a burning temperature of about 540° C. In consideration of this result, the burning temperature of the connecting electrodes 13 is preferably set to a temperature lower by 50° C. or more than the softening point of the glass substrate 4, that is, a low temperature near 540° C., thereby preventing the surface unevenness of the substrate 4.

The purpose of forming the connecting electrodes 13 is to electrically connect the cathode pattern 12 to the terminal electrodes 3. Therefore, the length of the connecting electrodes 13 can be relatively short, so that it is less necessary to achieve the high conductivity in the connecting electrodes 13 themselves. Accordingly, it is only necessary to mark a mechanical strength of the connecting electrodes 13 in case of burning at a low temperature near 540° C. The mechanical strength of the connecting electrodes 13 burned at such a low temperature can be ensured by suitably selecting the conductive paste containing Ag so that a relatively large amount (several tens of %) of a low-melting point glass component may be contained in the conductive paste.

Meanwhile, in the stage after burning the connecting electrodes 13 at a low temperature, there is a possibility that a very thin insulating layer (which is considered to be an oxide film of La, but the details thereof have not been clarified) is generated on the interface between the cathode pattern 12 and the connecting electrodes 13, resulting in disconnection between the cathode pattern 12 and the terminal electrodes 3. However, after the completion of the cathode-side panel including this insulating layer and the assembling of the plasma display panel shown in FIG. 1A, the insulating layer can be immediately broken by applying a voltage (100–200 V) to the plasma display panel. Thus, the insulating layer has no adverse effect on actual use of the plasma display panel.

The plasma display panel of a D.C. discharging type shown in FIG. 1A is constructed by assembling the cathode-side panel completed above and the anode-side panel along with the sealing member 11.

Light emission by discharging can be effected by applying a voltage between the anodes and the cathodes of the plasma display panel. In the experiment, a sample of the plasma display panel was prepared by setting a cell pitch (a length of one side of each cell) to 0.35 mm, a line width of the cathode line 12*a* to 0.18 mm, a width of each barrier rib 10 to 0.15 mm, and a height of each barrier rib 10 to 0.15 mm, and by using an Ne-Ar mixture gas (0.5 vol. % of Ar) with 350 Torr as a discharging gas to be sealed. An initial discharge starting voltage in the stage where no voltage was applied to the trigger electrode was about 180 V for each cell. Thereafter, when a voltage was continuously applied between the anodes and the cathodes, an aging effect was soon developed to increase a luminance and to achieve discharge starting voltage of 110–120 V and a discharge maintaining voltage of 95–100 V for each cell, thus obtaining the characteristic of the $LaB_6$ cathodes.

Figure 4:
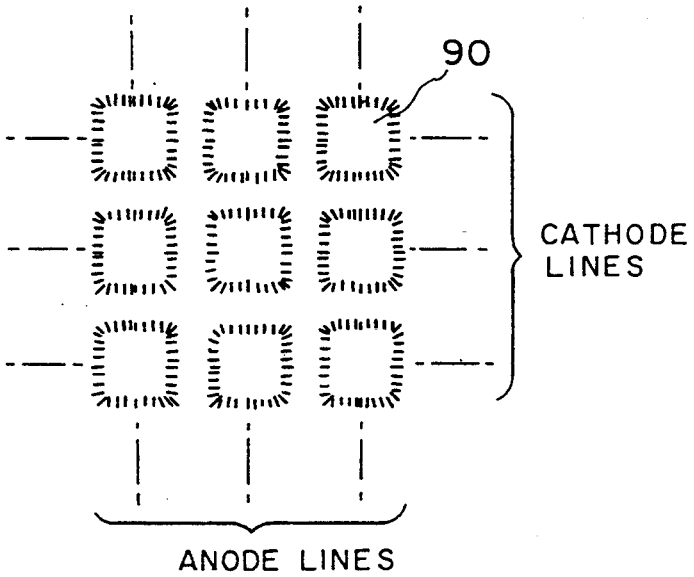
FIG. 4 is a schematic view illustrating a normal luminous shape of each luminous cell in the plasma display panel shown in FIG. 1A.

FIG. 4 shows a luminous condition of each cell 90 at this time. As apparent from FIG. 4, the luminous shape of each luminous cell 90 is uniform and satisfactory.

Example 2

Figure 5:
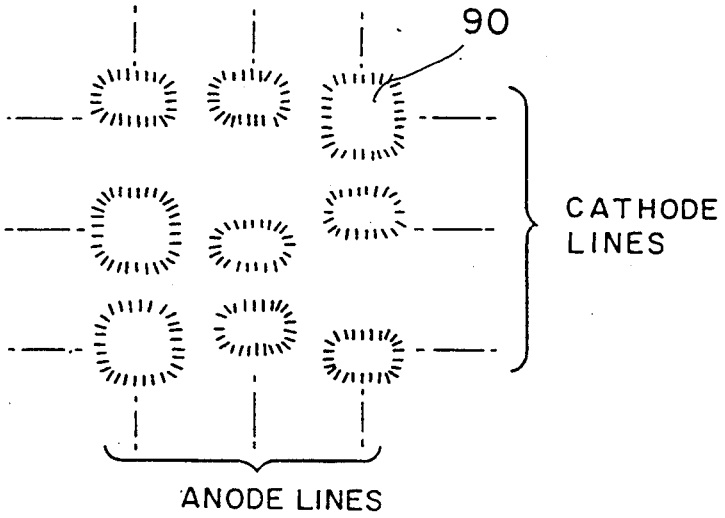
FIG. 5 is a schematic view illustrating an abnormal luminous shape of each luminous cell in the plasma display panel shown in FIG. 1A.

However, there is a possibility that the form of each cell 90 becomes nonuniform as shown in FIG. 5 as the above-mentioned aging proceeds. In particular, partial illuminating of each cell 90 or the disorder in shape of the illuminating cells 90 will occur. While this nonuniformity in the form of each cell 90 is gradually improved by continuing the aging with the voltage of 150 V, the uniform condition as shown in FIG. 4 cannot be restored, and such nonuniform shape of each cell 90 finally becomes stable.

Figure 6:
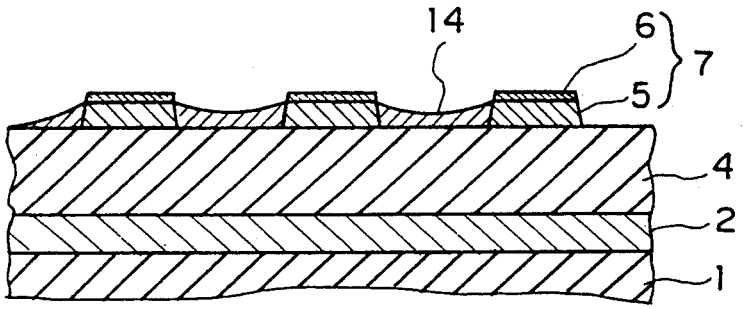
FIG. 6 is a sectional view illustrating the generation of a film between the adjacent cathode lines due to aging.

Further, when the aging is continued for a long period with the voltage of 150 V, there is a possibility of occurrence of short-circuit between the adjacent cathode lines 12*a*. That is, as shown in FIG. 6, it has been found that a conductive film 14 is formed between the adjacent cathode lines 12*a* in such a manner as to grow from the side walls of the adjacent lines, thus causing the short-circuit. Further, it has also been found that a primary component of the conductive film 14 is Al. From these facts, it is assumed that the exposed side walls of the adjacent Al layers 5 are sputtered by the aging to form the conductive film 14. The formation of the conductive film 14 is also caused with the fact that the pattern edges of the adjacent cathode lines 12*a* are steep to be susceptible to concentrated discharge and to amplify a local sputtering trouble.

In view of the above circumstances, the following limitations must be accepted in order to practically apply the cathode pattern 12 composed of the Al layer 5 and the $LaB_6$ layer 6.

1. The luminous shape of each luminous cell is allowed to stand in the disordered condition.
2. The voltage to be applied is to be reduced to a level equal to or less than 120 V, and a discharge current is also to be suppressed as greatly as possible to thereby suppress sputtering of the side walls of each Al layer 5.

However, these limitations give rise to obstacles in the aspects of a display quality and luminance.

Accordingly, it is desired to make uniform the luminous shape of each luminous cell after aging and to suppress the occurrence of the short-circuit between the adjacent lines of the cathode pattern without providing the above limitations.

There will now be described another example accomplished in view of the above discussion, in which the same reference numerals as those in Example 1 designate the same elements.

Figure 7:
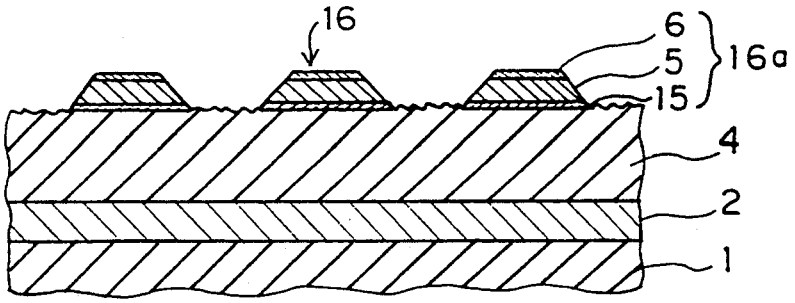
FIG. 7 is a sectional view of a discharge cathode device according to another embodiment of the present invention.

Referring to FIG. 7 showing Example 2, reference numeral 15 designates a Cr thin film layer, and reference numeral 16 designates a multilayer cathode pattern made up of the Cr thin film layer 15, an Al layer 5 and an $LaB_6$ layer 6. It has been confirmed that no short-circuit is generated between the adjacent cathode lines 16*a* in actually using a plasma display panel including the cathode pattern 16 with an applied voltage of about 150 V.

According to this preferred embodiment, the Cr thin film layer 15 is formed as an underlying layer for the Al layer 5 to thereby greatly improve the luminous shape of each luminous cell and the short-circuit between the adjacent cathode lines 16*a*. It is generally known that the formation of the Cr thin-film layer 15 as the underlying layer for the Al layer 5 contributes to enhance adhesion of the Al layer 5 to the underlying layer (the Cr thin film layer 15). However, it is considered that enhancing the adhesion does not directly relate to great improvement in the discharge characteristics. This is because it has been observed that the cathode pattern 12 made up of the Al layer 5 and the $LaB_6$ layer 6 in the previous example does not peel off at the end of aging.

As the result of investigation, it has been confirmed that Cr is diffused into the Al layer 5 to wholly modify the Al layer 5 in the burning step for the connecting electrodes 13. That is, it is assumed that a pattern edge of Al-Cr alloy can exhibit resistance against sputtering to extend a discharge life.

Figure 8:
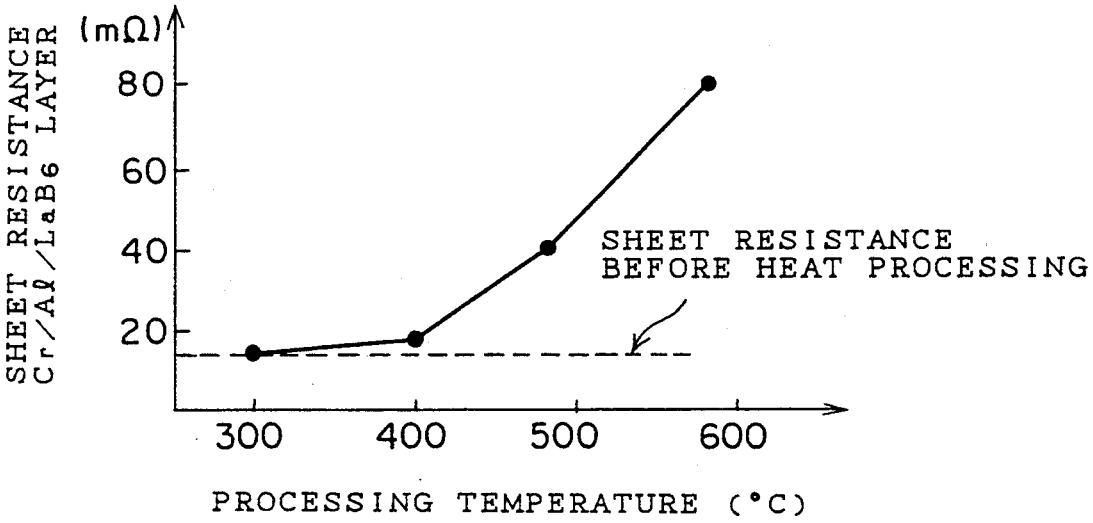
FIG. 8 is a graph showing a resistance characteristic of a $Cr/Al/LaB_6$ cathode layer in the discharge cathode device shown in FIG. 7 with respect to burning temperature.

FIG. 8 shows a change in sheet resistance of the cathode pattern 16 with respect to change in temperature of heat processing, in which a solid line represents the sheet resistance after heat processing and a dashed line represents the sheet resistance before heat processing. A period of time for heat processing is 15 minutes.

The graph shows that the sheet resistance before heat processing is 15 mΩ, which is a reasonable value because it is almost identical with that (14 mΩ) of the Al layer 5 having a thickness of 2 μm with no defects. As shown in FIG. 8, the sheet resistance increases with an increase in temperature of heat processing. For example, at a temperature corresponding to the burning temperature (about 500° C.) for the connecting electrodes 13, the sheet resistance becomes about three times that before heat processing. This change can be verified only by the fact that the Al layer 5 is modified in a bulk fashion by the heat processing. Further, this change in sheet resistance is not observed at all in the cathode pattern 12 consisting of the Al layer 5 and the $LaB_6$ layer 6 according to Example 1.

Figure 9:
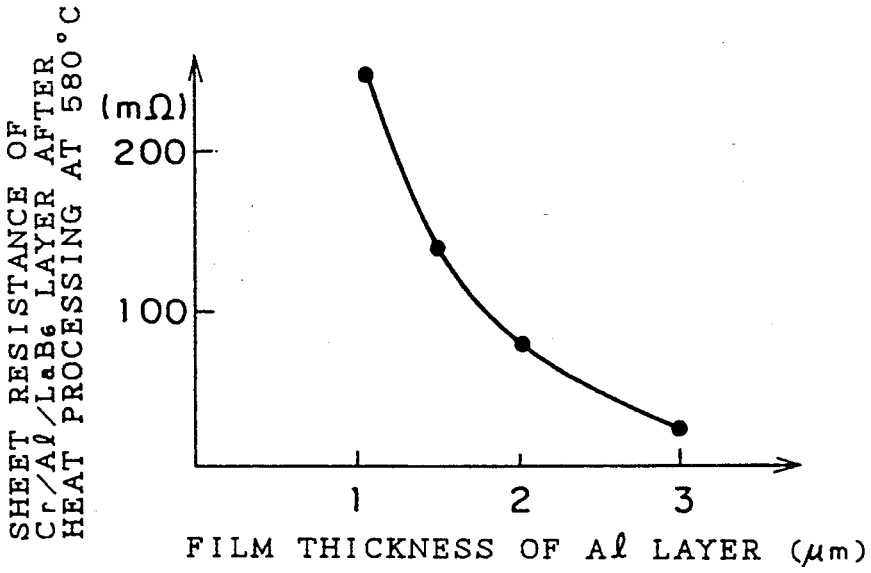
FIG. 9 is a graph showing a resistance characteristic of the $Cr/Al/LaB_6$ cathode layer with respect to thickness of an Al layer.

FIG. 9 shows a change in sheet resistance of the cathode pattern 16 after heat processing at a fixed temperature of 580° C. with respect to a change in film thickness of the Al layer 5. As apparent from FIG. 9, a rate of change in the sheet resistance increases with a decrease in the film thickness of the Al layer 5. It is considered to be sure from the above test data that any diffusion occurs in the interface between the Cr thin film layer 15 and the Al layer 5 owing to the heat processing. The depth of the diffusion reaches a level of 2 μm. Accordingly, it is considered that the side walls of the Al layer 5 are changed in composition by the burning of the connecting electrodes 13 to produce resistance against sputtering under discharge atmosphere and to realize an extension of a life.

The cathode pattern 16 is formed by the following method. First, the trigger electrode 2, the terminal electrodes 3 and the dielectric glass substrate 4 are formed on the cathode-side panel substrate 1 in the same way as that in Example 1. Then, a Cr thin film having a thickness of 0.15 μm, an Al thin film having a thickness of 2 μm and an $LaB_6$ thin film having a thickness of 0.2 μm are formed in this order by sputtering to form a multilayer thin film on the dielectric glass substrate 4. The thickness of the Cr thin film is preferably 0.05–0.3 μm.

Then, a photoresist is applied to a whole surface of the multilayer thin film formed on the glass substrate 4. The photoresist is then exposed to light through a predetermined mask pattern, and development is performed to form a predetermined resist pattern on the multilayer thin film. Thereafter, the $LaB_6$ thin film and the Al thin film are etched by a mixture liquid of phosphoric acid, acetic acid and nitric acid to thereby form the $LaB_6$ layer 6 and the Al layer 5.

Then, the Cr thin film is etched by a hot mixed solution of thiourea and sulfuric acid to thereby form the Cr thin film layer 15. Thus, the cathode pattern 16 made up of the Cr thin film layer 15, the Al layer 5 and the $LaB_6$ layer 6 corresponding to the resist pattern is formed on the glass substrate 4. Thereafter, the resist pattern is removed to obtain the constitution shown in FIG. 7.

In the etching step for the Cr thin film layer 15, the side edges of each Al layer 5 become tapered or trapezoid as shown in FIG. 7. Owing to such a tapered side edges, the possibility of concentrated discharge is reduced to thereby make the luminous shape of each luminous cell uniform.

After forming the cathode pattern 16, connecting electrodes 13 are formed at a burning temperature of about 500° C. to obtain a cathode-side panel. Then, the cathode-side panel obtained above and an anode-side panel similar to that in Example 1 are assembled to obtain a plasma display panel in the same way as that in Example 1. The plasma display panel thus obtained has a cell pitch of 0.35 mm, a line width of the cathode pattern 16 of 0.18 mm, a width of each barrier rib 10 of 0.15 mm and a height of each barrier rib 10 of 0.15 mm.

Using this plasma display panel, voltage application test similar to that in Example 1 was carried out. In the stage where no voltage was applied to the trigger electrode 2, the initial discharge starting voltage was about 180 V for each cell. At this time, the luminous shape of each luminous cell was uniform, and the alignment of the luminous cells was just regular like a matrix as shown in FIG. 4. Thereafter, when a voltage was continuously applied between the anodes and cathodes, the aging effect was soon developed to increase the luminance of each cell with the uniform shape maintained. Finally, a discharge starting voltage of 110–120 V and a discharge maintaining voltage of 95–100 V for each cell were reached to obtain the discharge characteristic of the $LaB_6$ cathodes.

Example 3

In Example 2 mentioned above, the Cr thin film layer 15 is formed directly on the glass substrate 4, and in the etching step for the Cr thin film layer 15, the glass substrate 4 is exposed to the etching liquid for etching the Cr thin film.

However, in some cases, the glass substrate 4 contains a component soluble to the etchant (the mixture liquid of thiourea and sulfuric acid) for etching the Cr thin film. In this case, the exposed surface of the glass substrate 4 after the etching of the Cr thin film becomes rough and looks white in appearance. Further, the roughness of the exposed surface is irregular. If the glass substrate 4 having such a rough surface is used to assemble the plasma display panel, the plasma display panel is deteriorated in contrast as a whole, and looks poor because of irregularity of the surface roughness. In addition, in the event that the surface roughness is large, there is a possibility that the luminous shape of each luminous cell is disordered as shown in FIG. 5 in spite of the presence of the Cr thin film layer 15.

Figure 10:
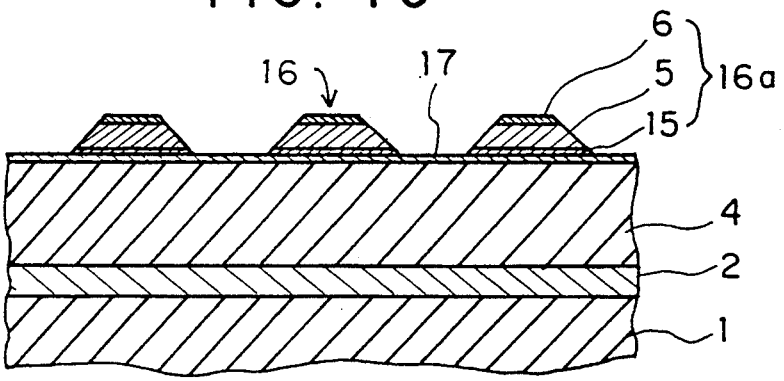
FIG. 10 is a sectional view of a discharge cathode device according to further embodiment of the present invention.

To cope with this problem, according to this example, an insulator thin film having a chemical resistance against the etchant for the Cr thin film layer 15, such as an $SiO_2$ thin film, is formed on the whole surface of the glass substrate 4. Referring to FIG. 10 showing this example, reference numeral 17 designates an $SiO_2$ thin film having a thickness of 0.3 μm formed by sputtering. The Si02 thin film 17 serves to protect the glass substrate 4 from erosion with the etchant, thereby maintaining a good visibility of the plasma display panel. Further, the insulator thin film 17 may be a thin film of a vitreous material to be obtained by thermal decomposition of alkoxide glass or the like.

Example 4

In the previous example, the generation of the short-circuit between the adjacent cathode lines **16*a* is suppressed by changing a composition of the Al layer 5**.

Figure 11:
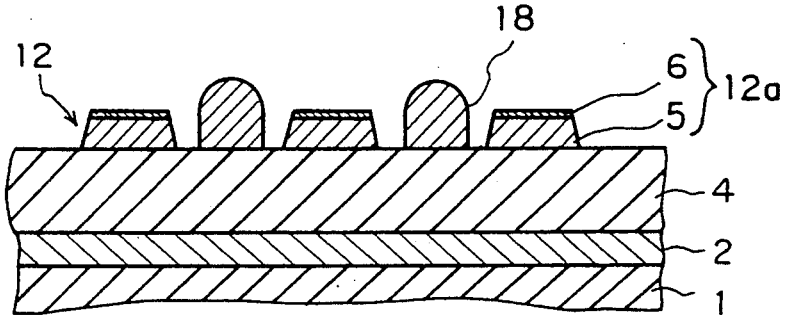
FIG. 11 is a sectional view of a discharge cathode device according to still further embodiment of the present invention.

To the contrary, according to this example as shown in FIG. 11, an insulator rib 18 of thick film glass is formed in a gap defined between the adjacent cathode lines **12*a*. The insulator rib 18** serves to geometrically suppress the generation of the short-circuit.

Figure 12:
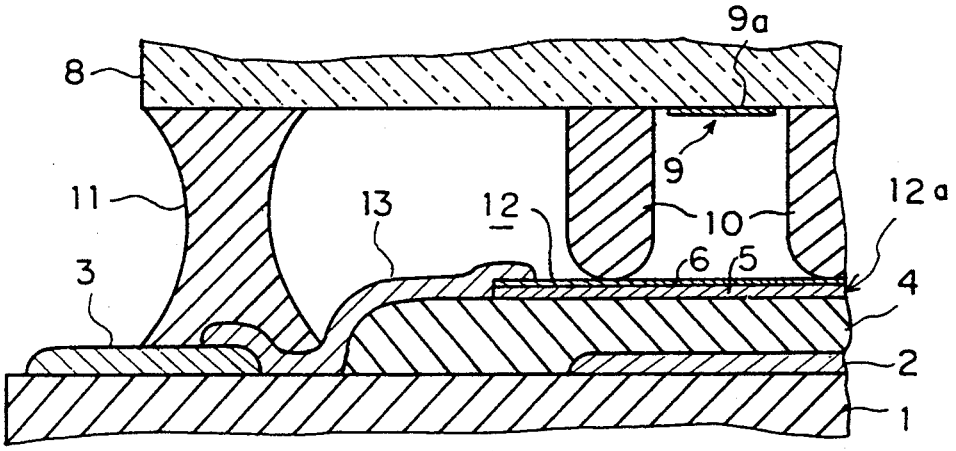
FIG. 12 is a sectional view of a sealing member and its peripheral area in the plasma display panel according to the above embodiments of the present invention.

Referring next to FIG. 12 showing a cross-sectional view of the sealing member 11 shown in FIG. 1A, there is illustrated that the sealing member 11 is located apart from both ends of each cathode line **12*a***. If the cathode pattern 12 penetrates the sealing member 11, the sealability of the discharge gas confined in the plasma display panel could not be ensured.

A mechanism of this fact will now be described. In general, the sealing member 11 is formed by heating a low-melting point glass at about 430° C. to fit it to the cathode-side panel substrate 1 and the anode-side panel substrate 8 and then by cooling the melted glass to harden the same. If the sealing member 11 is in contact with the cathode pattern 12, the cathode pattern 12 will be pulled on the lower side by the glass substrate 4 and will be also pulled on the upper side by the hardened sealing member 11 in the cooling stage of the sealing member 11. As a result, even if the difference in coefficient of thermal expansion between the glass substrate 4 and the sealing member 11 is little, abnormal strain will be generated in the cathode pattern 12 to cause separation of the cathode pattern 12 off either the glass substrate 4 or the sealing member 11. Accordingly, the sealing of the plasma display panel will be broken through such separation. Thus, it is necessary that the sealing member 11 is located apart from the cathode pattern 12 so as to contact the connecting electrodes 13 and/or the terminal electrodes 3.

Figure 16:
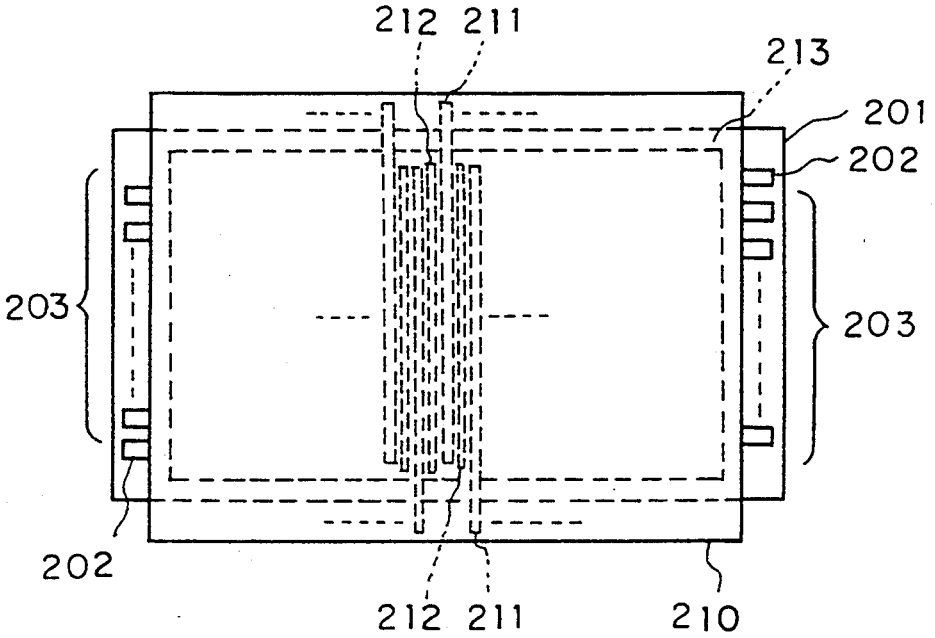
FIG. 16 (PRIOR ART)
FIG. 16 is a plan view of a plasma display panel of the type in which the present invention is utilized.

FIG. 16 is a plan view of a well-known type of D.C.-discharge-type plasma display panel having a trigger electrode and in which the present invention is utilized. Referring to FIG. 16, the plasma display panel includes a cathode-side panel substrate 201, an anode-side panel substrate 210 opposed to the cathode-side panel substrate 201, a transversely arranged anode pattern 211 consisting of a plurality of anode lines formed on the back surface of the anode-side panel substrate 210, a plurality of barrier ribs 212 formed on the back surface of the substrate 210 and disposed between the adjacent lines of the anode pattern 211, and a sealing member 213 made of glass for sealing a discharge gas in a space between the cathode-side panel substrate 201 and the anode-side panel substrate 210.

Figure 17:
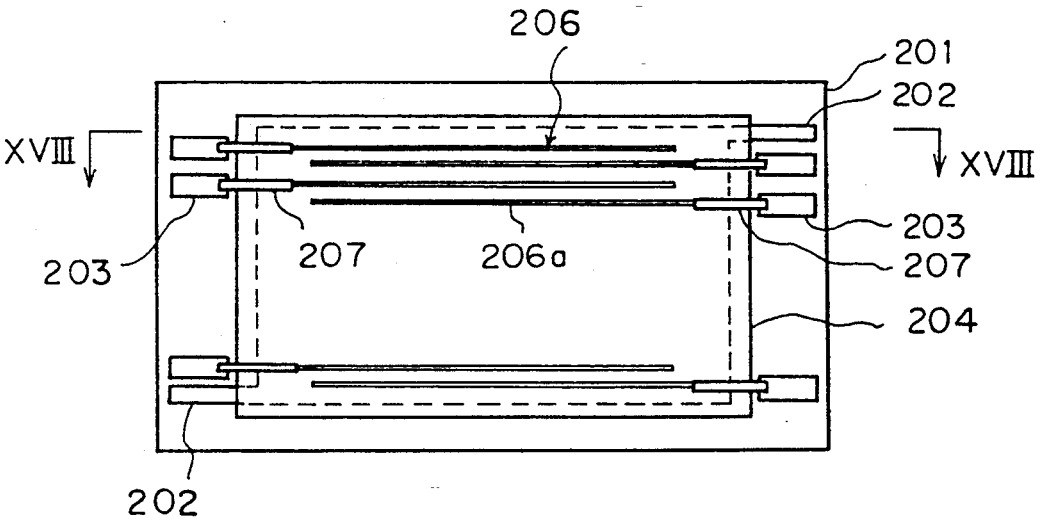
FIG. 17 is a plan view of a discharge cathode device for use in a display panel of the type shown in FIG. 16.

FIG. 17 is a plan view of a discharge cathode device of the present invention for use in a plasma display panel of the type shown in FIG. 16. Referring to FIG. 17, the discharge cathode device includes a trigger electrode 202 and a plurality of terminal electrodes 203 each formed on the cathode-side panel substrate 201, a dielectric substrate 204 covering the trigger electrode 202 except its terminal portions, a longitudinally arranged cathode pattern 206 consisting of a plurality of cathode lines 206*a* formed on the dielectric substrate 204, and a plurality of connection electrodes 207 for respectively connecting the cathode lines 206*a* to the terminal electrodes 203.

Figure 18:
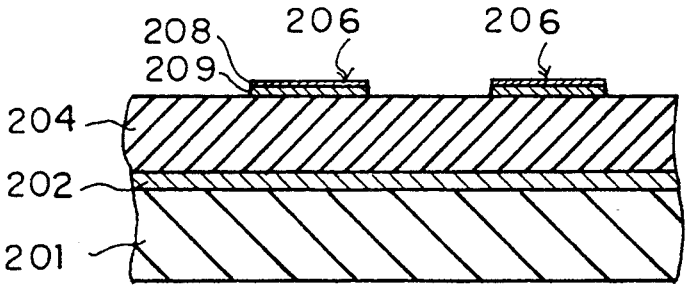
FIG. 18 is a partial cross-sectional view taken along the line XVIII—XVIII in FIG. 17.

Referring to FIG. 18 which is a partial cross sectional view taken along the line XVIII—XVIII in FIG. 17, an Al thin film 209 is formed on the dielectric substrate 204, and an $LaB_6$ thin film 208 is formed on the Al thin film 209. Thus, the cathode pattern 206 has a dual-layer structure consisting of the Al thin film 209 and the $LaB_6$ thin film 208.

In actually driving the plasma display panel shown in FIG. 16, a voltage of one hundred volt to a few hundred volts at the maximum is applied across the dielectric substrate 204 between the cathode pattern 206 and the trigger electrode 202. The dielectric substrate 204 must have an interlayer withstand voltage larger than the above applied voltage. The dielectric substrate 204, however, is made of a thick film material, thus having many defects such as voids therewithin to induce insulation breakdown. Further, the trigger electrode 202 is also made of a thick film material such as Ag, in general, so that a diffusion layer is formed in the interface between the dielectric substrate 204 and the trigger electrode 202. In addition, the surface of the thick-film trigger electrode 202 is rough, that is, many protrusions are present on the surface of the trigger electrode 202, so that defects to induce insulation breakdown are liable to be generated on the dielectric substrate 204 by the protrusions of the trigger electrode 202.

Accordingly, the withstand voltage of the dielectric substrate 204 is remarkably reduced at the defective portions and the diffusion layer. Thus, there exist many points where the withstand voltage of the dielectric substrate 204 is reduced under the cathode pattern 206 (occupying 30–80% of a display area of the plasma display panel). However, it is not allowed that the withstand voltage of the dielectric substrate 204 lowers a desired value.

To ensure the desired withstand voltage, it is known to set the thickness of the dielectric substrate 204 up to 50 μm or more in general. That is, the dielectric substrate 204 is formed by repeatedly printing three to five times and burning the print every time the printing is ended, so as to suppress the size of each defect generating in the dielectric substrate 204.

However, the above method increases the total number of steps. Furthermore, such great thickness of the dielectric substrate 204 causes an increase in ratio of occupying volume of the dielectric substrate 204 in the discharge gas space or trigger electrode 202 to volume of the discharge gas space between the anode pattern 211 and the dielectric substrate 204, thereby making it hard to obtain a trigger effect.

In addition, the increase in thickness of the dielectric substrate 204 causes large curving of the cathode-side panel substrate 201 after the burning of the dielectric substrate 204, which curving will interfere with the formation of the cathode pattern 206 in the subsequent thin film forming process. Moreover, the surface roughness of the dielectric substrate 204 as a thick film will make the thin film patterning process difficult.

Figure 19:
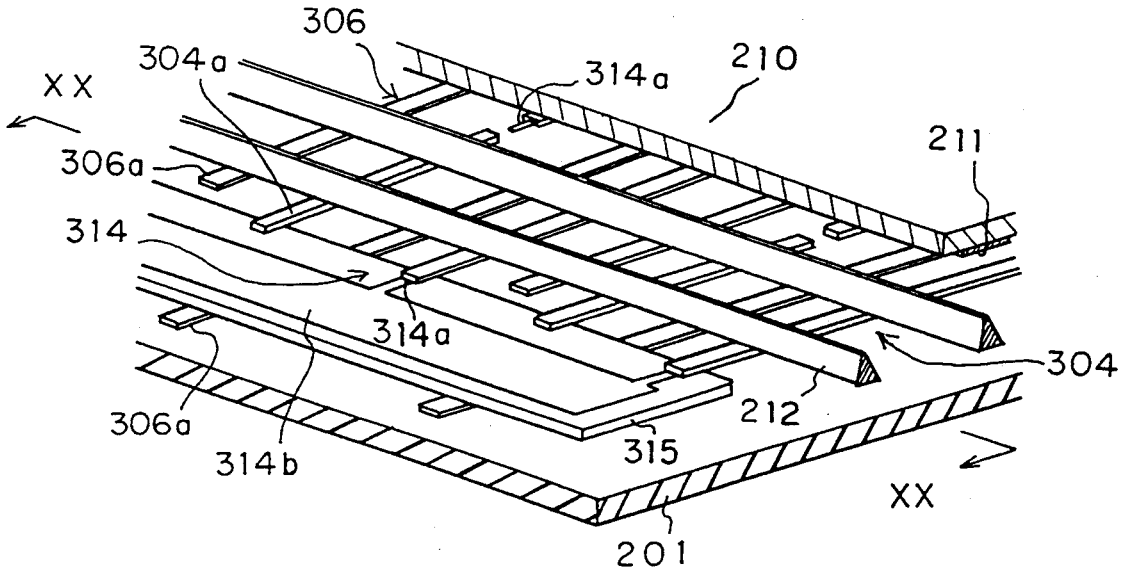
FIG. 19 (PRIOR ART)
FIG. 19 is a partial perspective view for an internal structure of a conventional plasma display panel having a trigger electrode pattern of plural lines.

Incidentally, to cope with the above problem of insulation between the dielectric substrate 204 and the cathode pattern 206, it is known to use a plurality of trigger electrode lines as proposed in Japanese Patent Laid-open Publication No. 3-269934. FIG. 19 is a perspective view of an internal structure of a plasma display panel having such trigger electrode lines. Referring to FIG. 19, the plasma display panel includes a trigger electrode pattern 314 consisting of a plurality of trigger electrode lines 314*a* and a trigger collecting electrode 314*b* connecting to and collecting these trigger electrode lines 314*a*. Further, an insulator film 315 is interposed between a cathode pattern 306 and the trigger collecting electrode 314b to effect interlayer insulation.

Figure 20:
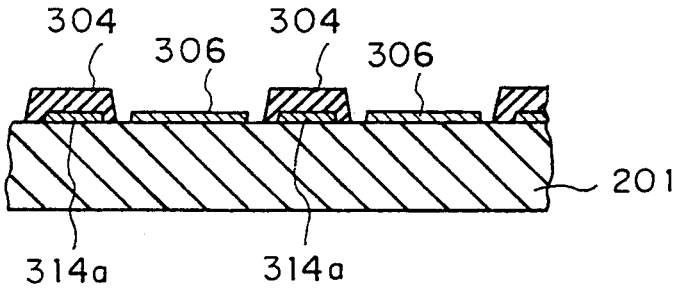
FIG. 20 (PRIOR ART)
FIG. 20 is a cross-sectional view taken along the line XX—XX in FIG. 19.

FIG. 20 is a partial cross sectional view taken along the line XX—XX in FIG. 19. In FIG. 20 omitted are an anode-side panel substrate 210, an anode pattern 211 and a plurality of barrier ribs 212.

As shown in FIG. 20, the trigger electrode lines pattern 314*a* and the cathode pattern 306 are disposed on the same plane. Each trigger electrode line 314*a* is disposed in a gap defined between the adjacent lines of the cathode pattern 306. Each of dielectric lines 304 is formed so as to cover each of the trigger electrode lines 314*a* and so as not to cover the cathode line 306*a*. With this constitution, the dielectric pattern 304 is separate from the cathode pattern 306, so that there is no problem of interlayer withstand voltage for the dielectric pattern 304 as above-mentioned.

However, instead there occurs a problem of interlayer withstand voltage for the insulator film 315 between the cathode pattern 306 and the trigger collecting electrode 314*b*. To ensure a desired withstand voltage of the insulator film 315, it is necessary to increase the thickness of the insulator film 315 by a thick film method as aforementioned. Accordingly, the problem of the increase in the number of steps mentioned previously still remains. Furthermore, the insulator film 315 and the dielectric pattern 304 must be individually formed, so that the total number of steps is further increased.

In this regard, the insulator film 315 and the dielectric pattern 304 may be collectively formed by inverting the cathode pattern 306 and the trigger collecting electrode 314*b* with respect to the insulating film 315, thereby suppressing the increase in the number of steps. However, the problem of the withstand voltage for the insulator film 315 still remains, and after all it cannot be expected that the number of steps becomes smaller than that in the conventional process for the discharge cathode device of the type FIG. 16.

Example 5

Figure 13:
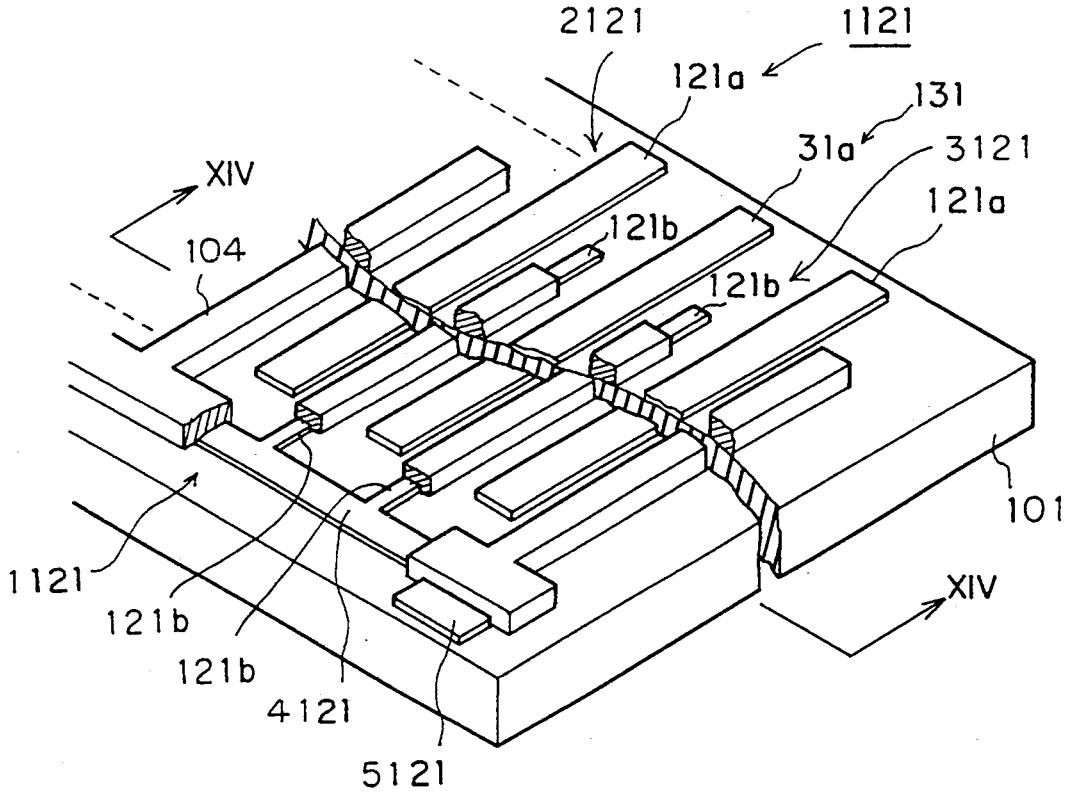
FIG. 13 is a partial perspective view of a discharge cathode device according to still further embodiment of the present invention.
Figure 14:
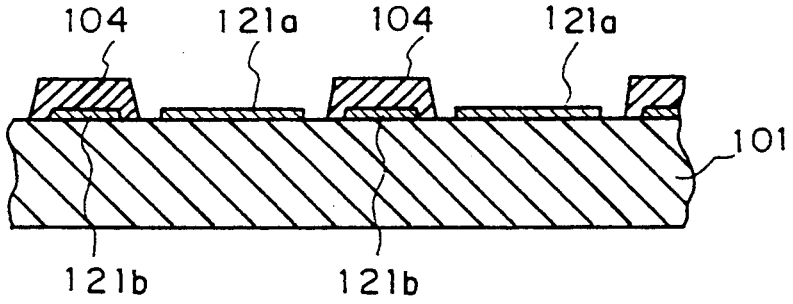
FIG. 14 is a partial cross-sectional view taken along the line XIV—XIV in FIG. 13.

Referring to FIGS. 13 and 14, there is shown a plasma display panel according to Example 5 of the present invention, in which an anode-side panel substrate, an anode pattern, a plurality of barrier ribs and a sealing member similar to those in the previous examples are not shown.

In FIG. 13, reference numeral 1121 generally designates a thin film pattern formed on a cathode-side panel substrate 101. Although not shown, the thin film pattern 1121 has a dual-layer structure consisting of an Al thin film pattern as a lower layer and an $LaB_6$ thin film pattern as an upper layer like the structure shown in FIG. 1B. The thin film pattern 1121 has a film thickness of 2.5 μm. The thin film pattern 1121 is made up of a cathode pattern 2121 consisting of a plurality of cathode lines 121*a*, a trigger electrode pattern 3121 consisting of a plurality of trigger electrode lines 121*b* arranged alternate with the cathode lines 121*a*, a trigger collecting electrode 4121 collecting the trigger electrode lines 121*b* at one end of the substrate 101, and a trigger electrode terminal 5121 extending from the trigger collecting electrode 4121.

The cathode lines 121*a* are drawn out on another side of the substrate 101 in a direction opposite to that of the trigger electrode lines 121*b*.

A dielectric pattern 104 is formed on the substrate 101 so as to fully cover the trigger electrode pattern 3121 and the trigger collecting electrode 4121. Accordingly, there is no problem in interlayer insulation between the cathode pattern 2121 and the other three of the trigger electrode pattern 3121, the trigger collecting electrode 4121 and the trigger electrode terminal 5121. That is, the insulator film 315 shown in FIG. 19 can be eliminated according to this example. Further, since there is no problem like interlayer insulation as, mentioned above, the dielectric pattern 104 is allowed to have a defect to such a degree that the trigger electrode pattern 3121 and the trigger collecting electrode 4121 are not exposed. Accordingly, the number of repetitions of screen printing for forming the dielectric pattern 104 can be reduced down to about two so that the thickness of the dielectric pattern 104 may become about 30 μm. In this connection, it is not necessary to perform burning of the dielectric pattern 104 every time the printing is performed, thus greatly easing the problem regarding the number of steps as mentioned previously. Further, since the thickness of the dielectric pattern 104 can be reduced to about 30 μm as mentioned above, the ratio of volume of the dielectric pattern 104 over the trigger electrode pattern 3121 to that of discharge gas atmosphere between the anode pattern and the dielectric pattern 104 can be decreased to thereby enhance a trigger effect.

Moreover, the cathode pattern 2121, the trigger electrode pattern 3121, the trigger collecting electrode 4121 and the trigger terminal electrode 5121 are formed together by one-cycle photolithography on a thin film having a dual-layer structure of $Al/LaB_6$. Therefore, the number of steps can be further reduced. Further, since the cathode-side panel substrate 101 has a good surface smoothness and flatness, it is advantageous for the photolithography for forming the thin film pattern 1121. This advantage can be also obtained in the case where the thin film pattern 1121 is formed of any material other than $Al/LaB_6$.

Further, the thin film pattern 1121 may be replaced by a thick film pattern formed of Ni or the like by screen printing and burning. Also in this case, the above-mentioned effects of reduction in the number of steps and no problem in interlayer insulation can be exhibited.

Example 6

In the above Example 5, the pattern edges of each cathode line 121*a* are exposed as shown in FIG. 14. Such a structure will cause the disorder of the luminous shape of each luminous cell as shown in FIG. 5. Further, there is a problem of short-circuit between the adjacent cathode lines on account of an accumulated discharge time as previously mentioned in Example 2. Regarding this problem of short-circuit, the previous Example 5 solves it with the dielectric pattern 104 disposed between the adjacent cathode lines 121*a*. However, since the height of the dielectric pattern 104 is only about 30 μm, the effect of suppressing the generation of short-circuit is limited.

As previously indicated, the disorder of the luminous shape of each luminous cell as shown in FIG. 5 is considered to be caused by the structure that the pattern edges of each cathode line 121*a* are steep. That is, it is considered that concentrated discharge at one or both of the steep pattern edges will incur the disorder of the form of each luminous cell. Further, the generation of short-circuit between the adjacent cathode lines 121*a* is considered to be caused by the phenomenon that the opposite side walls of each Al thin film are subjected to sputtering in the discharge atmosphere to emit Al atoms, which will be deposited in the gap defined between the adjacent cathode lines 121*a*. The concentrated discharge at the pattern edges accompanies an increase in local discharge current density, thereby amplifying the above sputtering trouble.

Figure 15:
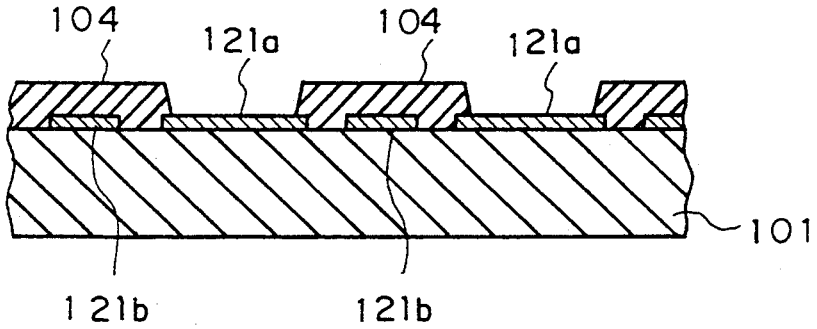
FIG. 15 is a sectional view of a discharge cathode device according to still further embodiment of the present invention.

These problems can be greatly eliminated together with the structure shown in FIG. 15 according to the present invention. As apparent from FIG. 15, the pattern edges of each cathode line 121*a* are covered with the dielectric pattern 104. According to this structure, the pattern edges of the cathode lines 121*a* can be prevented from being exposed to the discharge atmosphere, thereby remarkably eliminating the above problems of the concentrated discharge and the sputtering trouble. As a result, the luminous shape of each luminous cell can be made uniform as shown in FIG. 4 to thereby obtain a good image quality. Further, since the sputtering trouble is greatly suppressed, a discharge life can be greatly extended.

In this example, there will arise another problem in withstand voltage of the dielectric pattern 104 because the dielectric pattern 104 is in contact with both the cathode pattern 2121 and the trigger electrode pattern 2121. However, the withstand voltage to be now considered is that in the gap defined between the cathode pattern 2121 and the trigger electrode pattern 3121 formed on the same plane, and it is different in nature from the problem in interlayer withstand voltage as mentioned hereinbefore. Accordingly, the height of the dielectric pattern 104 need not be increased to thereby ensure the effect of reduction in the number of steps as in Example 5.

The withstand voltage of the dielectric pattern 104 in this example can be sufficiently ensured by adjusting a gap size between the adjacent cathode pattern 2121 and the trigger electrode pattern 3121, which will be attributed to the pattern design of the cathode pattern 2121 and the trigger electrode pattern 3121. That is, by setting a sufficient margin for the above gap in the pattern design, the probability of poor withstand voltage of the dielectric pattern 104 can be greatly reduced even if the printing or burning condition of the dielectric pattern 104 is somewhat changed.

Further, in the case where the cathode pattern and the trigger electrode pattern are formed by photolithography of a thick film formed of Ni or the like, the same effects as those mentioned above can be obtained.

It is to be understood that the effects of the image quality improvement and the discharge life extension obtained above are not related with the existence of the trigger electrode pattern 3121 under the dielectric pattern 104. That is, the above effects can be obtained by covering the steep pattern edges of the cathode pattern with an insulator.

What is claimed is:

1. A gas discharge display device comprising:

a cathode pattern and a trigger electrode pattern both formed on said cathode-side substrate, said cathode pattern comprising a plurality of cathode lines all of which are extended out to one side of the cathode-side panel, said trigger electrode pattern comprising a plurality of trigger electrode lines all of which are extended to another side of the cathode-side panel in a direction opposite to that of the cathode lines, each of said trigger electrode lines being covered by a dielectric pattern, said cathode lines being alternately arranged to each other, said trigger electrode pattern further comprising a trigger collecting electrode connected to said trigger electrode lines and extending in a direction different from the direction in which said trigger electrode lines are extended, said cathode lines having no intersecting portion with said trigger collecting electrode;

an anode-side panel having an anode pattern formed thereon;

a sealing means for sealing the cathode-side panel and the anode-side panel;

both of said cathode pattern and said trigger electrode pattern being formed as an entity and comprise the same material with each other; and wherein each of said cathode lines comprises a pattern edge at both sides thereof, said pattern edge at both sides thereof being covered by said dielectric pattern.

2. The gas discharge display device of claim 1, wherein the cathode pattern and the trigger electrode pattern comprise a multilayer structure having a $LaB_6$ thin film as one layer in said multilayer structure.

* * * * *

UNITED STATES PATENT AND TRADEMARK OFFICE

CERTIFICATE OF CORRECTION

PATENT NO. : 5,428,263

DATED : June 27, 1995

INVENTOR(S) : Shinichirou Nagano

It is certified that error appears in the above-indentified patent and that said Letters Patent is hereby corrected as shown below:

In the Abstract: Line 4, "yttnium" should be -- yttrium --; Col. 2, line 34, "lanthenum" should be -- lanthanum --; Col. 2, line 35, delete "or" (second occurrence); "yeltrium" should be -- yttrium --; Col. 2, line 42, after "lanthanum," insert -- a --; Col. 3, line 1, "or" (first occurrence) should be -- of --; after "lanthanum," insert -- a --; Col. 3, line 9, "landlanum" should be -- lanthanum --; Col. 3, line 19, "or" should be -- of --; Col. 3, line 20, before "lanthanide" insert -- a --; Col. 7, lines 9-10, "or either lanthanum, lanthanides" should be -- of lanthanoids --; Col. 14, line 31, "or" should be -- of --; Col. 15, line 27, after "type" insert -- shown in --; Col. 15, line 64, delete the comma; Col. 17, line 13, "2121" should be --3121 --.

Signed and Sealed this

Second Day of January, 1996

Bruce Lehman

*Attest:*

BRUCE LEHMAN

*Attesting Officer*

*Commissioner of Patents and Trademarks*